US010876545B2

(12) United States Patent
Ediger

(10) Patent No.: US 10,876,545 B2
(45) Date of Patent: Dec. 29, 2020

(54) SYSTEM AND APPARATUS FOR PROVIDING A DIRECTED AIR FLOW

(71) Applicant: Vornado Air LLC, Andover, KS (US)

(72) Inventor: Glen W Ediger, North Newton, TX (US)

(73) Assignee: Vornado Air, LLC, Andover, KS (US)

( * ) Notice: Subject to any disclaimer, the term of this patent is extended or adjusted under 35 U.S.C. 154(b) by 80 days.

(21) Appl. No.: 16/378,497

(22) Filed: Apr. 8, 2019

(65) Prior Publication Data

US 2019/0309758 A1 Oct. 10, 2019

Related U.S. Application Data

(60) Provisional application No. 62/655,138, filed on Apr. 9, 2018.

(51) Int. Cl.

| | |
|---|---|
| ***F04D 29/54*** | (2006.01) |
| ***F04D 19/00*** | (2006.01) |
| ***F04D 29/52*** | (2006.01) |
| ***F04D 29/64*** | (2006.01) |
| ***F04D 29/70*** | (2006.01) |

(52) U.S. Cl.

CPC ..... *F04D 29/54* (2013.01); *F04D 19/002* (2013.01); *F04D 29/522* (2013.01); *F04D 29/644* (2013.01); *F04D 29/703* (2013.01)

(58) Field of Classification Search

CPC ..... F04D 29/54; F04D 29/703; F04D 25/14
USPC ..... 416/246, 247 R
See application file for complete search history.

(56) References Cited

U.S. PATENT DOCUMENTS

| | | | | | |
|---|---|---|---|---|---|
| 1,489,704 | A | * | 4/1924 | Kleshick | F04D 29/526 150/165 |
| 1,536,754 | A | * | 5/1925 | Benson | F04D 3/005 415/190 |
| 1,945,071 | A | * | 1/1934 | Popp | F03B 15/12 415/32 |
| 2,056,547 | A | * | 10/1936 | Weber | F04D 29/34 416/188 |
| 2,345,516 | A | * | 3/1944 | Weber | F04D 29/703 248/130 |
| D144,034 | S | * | 3/1946 | Budlong | D23/377 |
| D150,559 | S | * | 8/1948 | Eckles | D23/377 |
| 2,453,009 | A | * | 11/1948 | Ganger | F04D 29/703 416/244 R |
| D152,516 | S | * | 2/1949 | Brown | D23/411 |
| D153,099 | S | * | 3/1949 | Barnes | D23/370 |
| D153,542 | S | * | 4/1949 | Owens et al. | D23/382 |
| 2,544,281 | A | * | 3/1951 | Seil | F04D 29/646 248/130 |

(Continued)

*Primary Examiner* — Moshe Wilensky
*Assistant Examiner* — Brian Christopher Delrue

(57) ABSTRACT

The present invention is related to an improved fan design. According to an exemplary preferred embodiment, the improved fan design of the present invention preferably includes a fan main body having fan blades, a front grill, a flexible guide cone, an air inlet, and supporting legs movable from a first position to a second position. According to preferred embodiments, the flexible guide cone is preferably also movable from a first position to a second position. In the first position, the flexible guide cone preferably forms a first shape which conforms to the surface of the air inlet. In a second position, the flexible guide cone preferably extends away from the air inlet.

10 Claims, 7 Drawing Sheets

(56) References Cited

U.S. PATENT DOCUMENTS 2,554,601 A * 5/1951 Sutton ..... F04D 29/646 415/182.1
2,554,602 A * 5/1951 Sutton ..... F04D 29/545 415/222
2,593,217 A * 4/1952 Sutton ..... F04D 29/646 417/313
2,603,468 A * 7/1952 Sutton ..... F04D 29/705 261/104
2,641,191 A * 6/1953 Buchi ..... F04D 29/445 415/188
2,653,757 A * 9/1953 Segalman ..... F04D 29/541 415/148
2,654,533 A * 10/1953 Collins ..... F04D 29/703 416/247 R
2,805,820 A * 9/1957 Evarts ..... F04D 29/646 417/238
2,812,900 A * 11/1957 Matthews ..... F04D 29/703 416/247 R
2,857,095 A * 10/1958 Suarez Grau ..... F04D 29/646 416/246
2,923,463 A * 2/1960 Shunkwiler ..... F04D 29/703 416/247 R
3,274,757 A * 9/1966 Wapler ..... F01D 25/32 96/359
3,347,452 A * 10/1967 Radcliffe ..... F04D 29/703 416/170 R
3,667,860 A * 6/1972 Endress ..... F04D 17/122 415/150
3,787,142 A * 1/1974 Dupke ..... F04D 29/703 416/247 R
3,963,382 A * 6/1976 Patton ..... F04D 29/646 417/361
4,120,615 A * 10/1978 Keem ..... F04D 29/526 417/360
4,149,689 A * 4/1979 McDonald ..... B64D 33/02 244/134 C
4,222,318 A * 9/1980 Patton ..... F04D 25/08 248/126
4,249,428 A * 2/1981 Herron ..... F16H 53/06 112/459
4,341,151 A * 7/1982 Sakamoto ..... G01F 5/00 454/209
4,443,965 A * 4/1984 Gie ..... A01M 1/06 15/246
4,456,431 A * 6/1984 Crespin ..... F04D 29/326 416/189
4,477,272 A * 10/1984 Hollis ..... F24F 13/28 55/471
4,515,538 A * 5/1985 Shih ..... F04D 27/00 248/343
D281,277 S * 11/1985 Wimsatt ..... D23/381
D281,352 S * 11/1985 Chang ..... D23/370
4,643,639 A * 2/1987 Caine ..... F04D 29/468 277/412
4,650,342 A * 3/1987 Goodwin ..... B01F 7/00733 366/264
4,657,483 A * 4/1987 Bede ..... F04D 29/545 415/210.1
D307,320 S * 4/1990 Shin-Chin ..... 416/246
4,917,577 A * 4/1990 Stirling ..... B01F 3/04617 261/93
4,927,324 A * 5/1990 Coup ..... F04D 25/08 415/121.2
5,118,252 A * 6/1992 Chaney ..... F04D 29/703 415/119
5,179,862 A * 1/1993 Lynnworth ..... G01F 1/662 73/861.28
5,221,180 A * 6/1993 Crider ..... F04D 29/703 403/11
5,295,811 A * 3/1994 Chiu ..... F04D 25/08 248/127
5,304,040 A * 4/1994 Wang ..... F04D 29/646 248/188.2
5,305,907 A * 4/1994 Richardson ..... B65F 1/08 150/154
5,348,447 A * 9/1994 Redetzke ..... F04D 29/703 416/247 R
5,352,094 A * 10/1994 Peng ..... F04D 29/703 416/247 R
5,431,544 A * 7/1995 Hsu ..... F04D 29/601 248/664
5,435,695 A * 7/1995 Chiu ..... F04D 29/601 416/244 R
5,613,833 A * 3/1997 Wolfe ..... F04D 29/601 416/246
5,725,356 A * 3/1998 Carter ..... F04D 25/08 416/240
5,944,488 A * 8/1999 Matson ..... F04D 29/703 415/121.2
6,045,329 A * 4/2000 Sobala ..... F04D 29/703 416/146 R
6,126,415 A * 10/2000 Lasko ..... F04D 29/646 416/146 R
D434,484 S * 11/2000 Reede ..... D23/365
6,183,200 B1 * 2/2001 Chang ..... A01M 29/12 415/121.2
6,183,203 B1 * 2/2001 Grintz ..... F04D 29/601 416/246
6,244,823 B1 * 6/2001 Marino ..... F04D 25/105 416/246
6,296,449 B1 * 10/2001 Wang ..... F04D 29/703 416/247 R
6,336,793 B1 * 1/2002 Litvin ..... F04D 25/08 248/126
6,347,922 B1 * 2/2002 Wang ..... F04D 29/384 415/121.2
6,364,618 B1 * 4/2002 Moreno ..... F04D 29/703 403/13
6,386,828 B1 * 5/2002 Davis ..... A01K 1/0052 415/147
D458,357 S * 6/2002 Reede ..... D23/365
6,398,835 B1 * 6/2002 Rehil ..... B01D 46/10 55/471
6,439,085 B1 * 8/2002 Habermehl ..... B25B 23/00 81/434
D463,854 S * 10/2002 Reede ..... D23/365
6,533,543 B2 * 3/2003 Tagomori ..... F04D 29/4273 415/159
7,011,500 B2 * 3/2006 Matson ..... F04D 29/601 415/121.2
7,381,129 B2 * 6/2008 Avedon ..... F04D 25/088 454/230
7,530,783 B1 * 5/2009 Ediger ..... F04D 29/646 415/121.2
7,621,498 B2 * 11/2009 Tang ..... F04D 29/60 248/317
D621,025 S * 8/2010 Peterson ..... D23/382
D621,026 S * 8/2010 Peterson ..... D23/382
7,856,834 B2 * 12/2010 Haley ..... F04D 27/0246 62/115
8,006,916 B2 * 8/2011 Metcalf ..... F24F 6/14 239/8
D645,555 S * 9/2011 Peterson ..... D23/411
D645,952 S * 9/2011 Peterson ..... D23/411
D645,953 S * 9/2011 Peterson ..... D23/411
8,152,453 B2 * 4/2012 Oleson ..... F04D 25/105 415/126
8,182,218 B2 * 5/2012 Pearce ..... F04D 29/544 415/220
8,210,824 B1 * 7/2012 Bucher ..... F04D 29/703 416/244 R
8,424,566 B2 * 4/2013 Merchant ..... F04D 29/548 137/565.37
D683,841 S * 6/2013 McNicholas ..... D23/412
8,560,031 B2 * 10/2013 Barnett ..... F16M 11/105 455/575.8

(56) References Cited

U.S. PATENT DOCUMENTS 8,579,582 B1 * 11/2013 Gehring ..... F04D 29/526 415/182.1
D695,385 S * 12/2013 McNicholas ..... D23/354
8,622,706 B2 * 1/2014 Burgess ..... B01F 7/22 416/185
8,894,377 B2 * 11/2014 Greenberg ..... F04D 29/646 416/247 R
9,080,580 B2 * 7/2015 Heli ..... F04D 29/646
9,097,261 B2 * 8/2015 Haaf ..... F04D 29/541
9,297,385 B2 * 3/2016 Yamanaka ..... F04D 29/669
9,353,765 B2 * 5/2016 Haley ..... F04D 29/462
9,683,579 B2 * 6/2017 Mizuno ..... F04D 25/08
9,897,090 B2 * 2/2018 Burgess ..... F04D 29/4273
10,507,422 B2 * 12/2019 Combs ..... B01D 46/0047
10,634,165 B2 * 4/2020 Mehlhorn ..... F04D 19/002
2001/0018023 A1 * 8/2001 Tagomori ..... F04D 29/669 415/220
2001/0021344 A1 * 9/2001 Miyamoto ..... F04D 29/667 415/119
2003/0024233 A1 * 2/2003 Snyder ..... F01D 25/162 60/39.092
2003/0235501 A1 * 12/2003 Herndon ..... F04D 29/703 416/146 R
2004/0094662 A1 * 5/2004 Sanders, Jr. ..... B64C 27/20 244/12.5
2006/0286924 A1 * 12/2006 Milana ..... F04D 25/0613 454/259
2009/0023378 A1 * 1/2009 Hansen ..... F04D 25/14 454/259
2009/0099737 A1 * 4/2009 Wendte ..... A01D 41/1243 701/50
2009/0166444 A1 * 7/2009 Peterson ..... F04D 29/705 239/13
2009/0208353 A1 * 8/2009 Weiser ..... F04D 25/08 417/410.1
2010/0135765 A1 * 6/2010 Burgess ..... F04D 13/12 415/1
2012/0014807 A1 * 1/2012 Liang ..... F04D 29/703 416/247 R
2013/0064679 A1 * 3/2013 Tsai ..... A01M 1/06 416/247 R
2014/0140861 A1 * 5/2014 Pellenc ..... F04D 25/0673 417/44.1
2014/0363273 A1 * 12/2014 Burman ..... F04D 3/02 415/97
2016/0131157 A1 * 5/2016 Burman ..... F04D 29/528 415/208.2
2018/0202465 A1 * 7/2018 Randall ..... F04D 29/703
2019/0309758 A1 * 10/2019 Ediger ..... F04D 29/541

* cited by examiner

SYSTEM AND APPARATUS FOR PROVIDING A DIRECTED AIR FLOW

RELATED APPLICATIONS

The present application claims priority to U.S. Provisional Application No. 62/655,138 filed Apr. 9, 2018.

FIELD OF INVENTION

The present invention is related in general to an improved fan design, and in particular, to an improved air fan apparatus for intaking and directing air.

BACKGROUND OF THE INVENTION

In the modern world, fans are commonly used in a variety of locations and environments. In many situations, small, travel sized fans are useful. However, these fans are typically very limited in the air flow they can provide. Additionally, current designs are often bulky and difficult to transport.

To overcome these limitations, the present invention provides an improved air fan apparatus which allows for a smaller, collapsible fan which is capable of enhanced air flow.

SUMMARY OF THE DISCLOSURE

To minimize the limitations found in the prior art, and to minimize other limitations that will be apparent upon the reading of the specifications, the preferred embodiment of the present invention provides an improved fan design with an improved air intake system and collapsible stand structure.

According to an exemplary preferred embodiment, the improved fan design of the present invention preferably includes a fan main body having fan blades, a front grill, a flexible guide cone, an air inlet, and supporting legs movable from a first position to a second position. According to preferred embodiments, the flexible guide cone is movable from a first position to a second position. In the first position, the flexible guide cone preferably forms a first shape which conforms to the surface of the air inlet. In a second position, the flexible guide cone preferably extends away from the air inlet.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness. It should be understood that the scope of the present invention is intended to be limited solely by the appended claims.

DETAILED DESCRIPTION OF THE DRAWINGS

In the following discussion that addresses several embodiments and applications of the present invention, reference is made to the accompanying drawings that form a part hereof, and in which is shown by way of illustration specific embodiments in which the invention may be practiced. It is to be understood that other embodiments may be utilized, and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
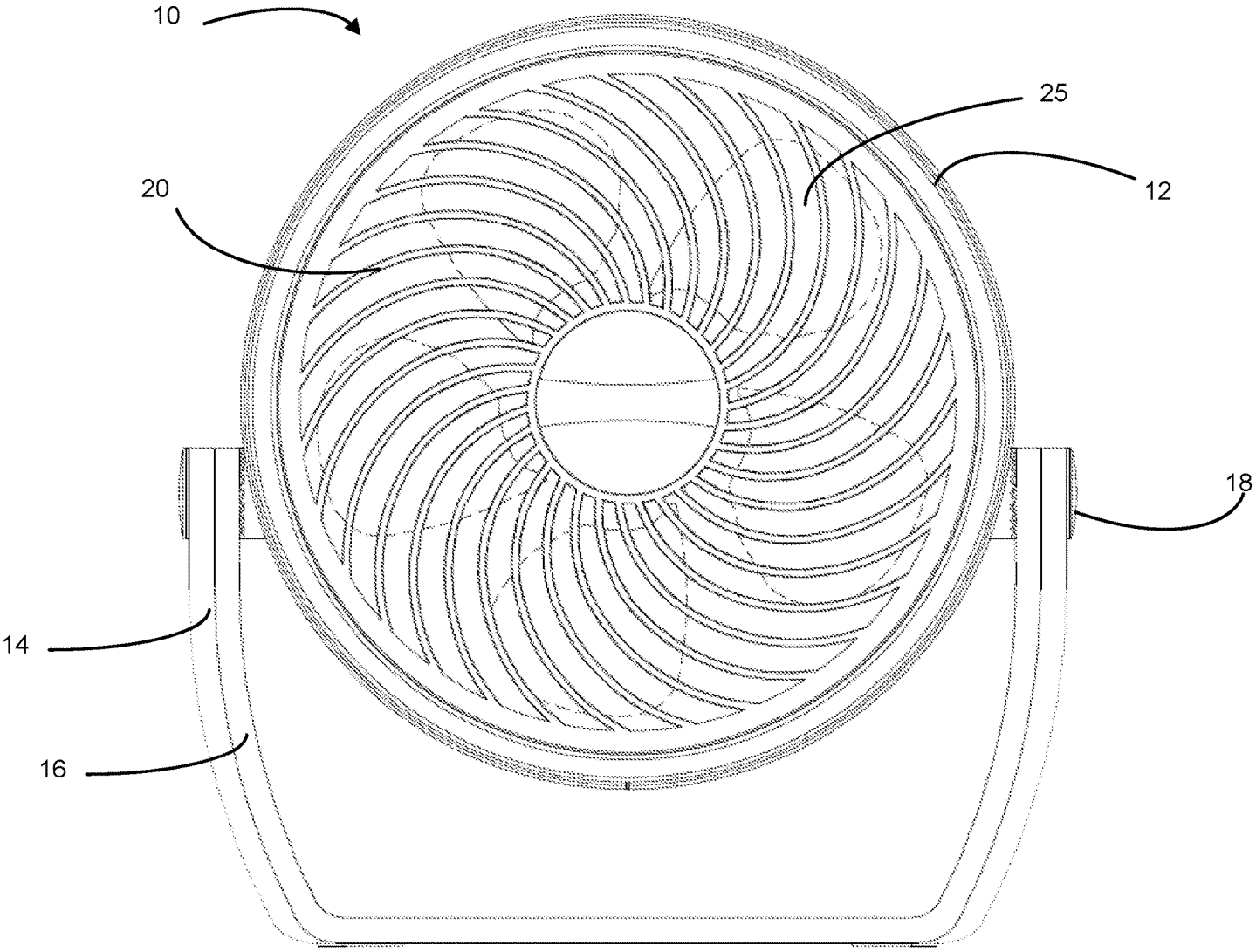
FIG. 1 shows a front view of a fan assembly in a first position in accordance with a first preferred embodiment of the present invention.

FIG. 1 shows a front view of a fan assembly in accordance with a first preferred embodiment of the present invention. As shown in FIG. 1, the fan assembly 10 of the present invention may preferably include a fan main body 12 enclosing a set of fan blades 25. As further shown, the fan main body 12 may support a front grill 20 for protecting the fan blades 25 and directing the flow of air from the fan assembly 10. As further shown in FIG. 1, the fan assembly 10 may preferably further include front and rear supporting legs 14, 16. According to a preferred embodiment, the front and rear supporting legs 14, 16 may preferably connected to the main fan body 12 via an adjustable joint mechanism 18 or the like. Preferably, the adjustable joint mechanism 18 may preferably allow the front and rear supporting legs 14, 16 to be fully adjustable and may allow for tilt adjustment, and a variety of lockable positions.

Figure 2:
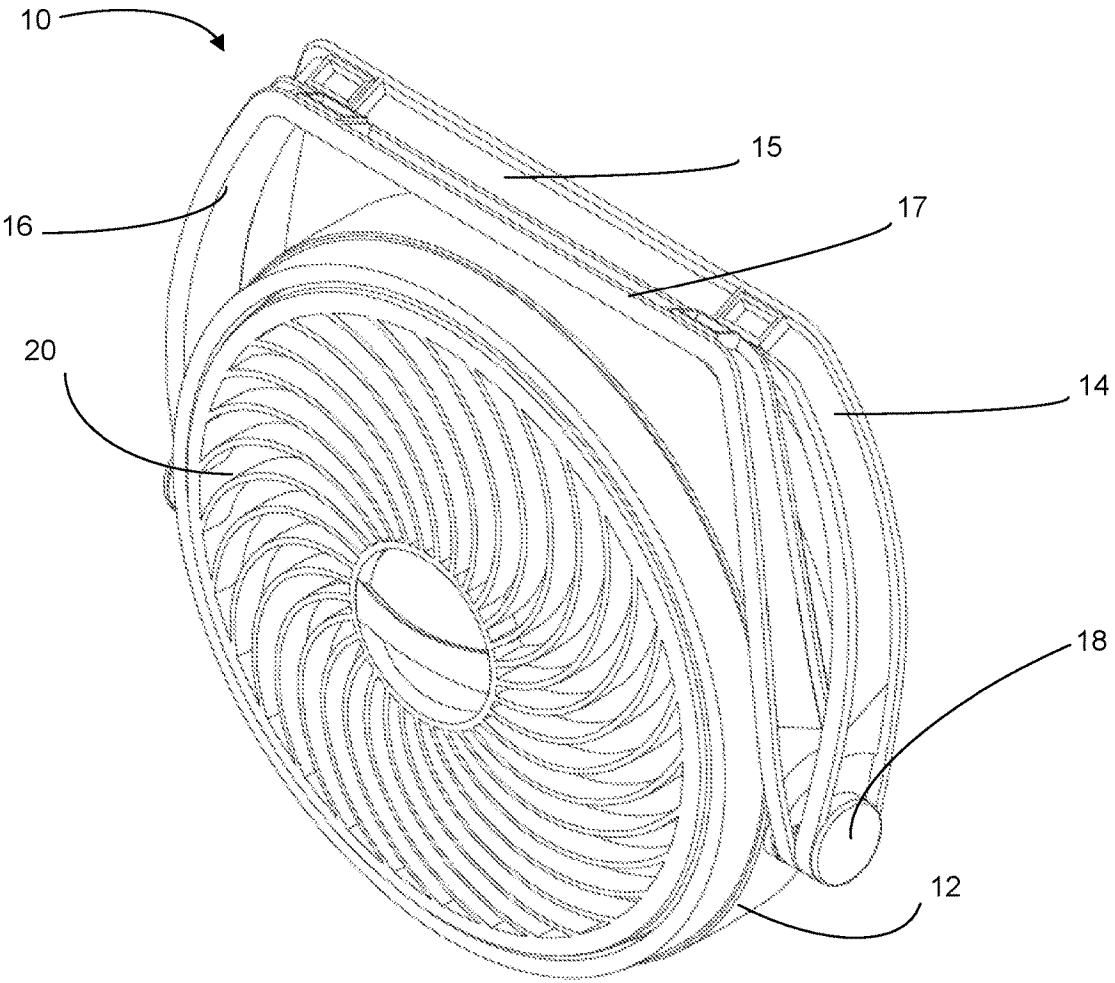
FIG. 2 shows a front perspective view of a fan assembly in a second position in accordance with a further preferred embodiment of the present invention.

According to a preferred embodiment, the adjustable joint mechanism 18 may preferably allow the front and rear supporting legs 14, 16 to rotationally move from at least a first position beneath the fan body 12 to a second position above the fan body 12. Preferably, the supporting legs 14, 16 may be configured to lock into the first position and act as a stand to elevate the fan body 12 above a given surface. As shown in FIG. 1, the supporting legs 14, 16 may be moved to a first exemplary first position. With reference to FIG. 2, the supporting legs 14, 16 may move from the first position (shown in FIG. 1) to a second position so that the respective lower leg sections 15, 17 are in close proximity and/or touching. In this way, the lower leg sections 15, 17 may be positioned to act as a handle or the like.

According to a further preferred embodiment, the supporting legs 14, 16 may be constructed with bumps and notches to assist in keeping the legs in the proper position. According to preferred embodiment, the pivot point 18 may preferably be located below the center-line of the fan body 12 to allow the supporting legs 14, 16 to be flipped above the fan body 12 to minimize the overall size of the fan assembly 10 for travel and storage.

Figure 3:
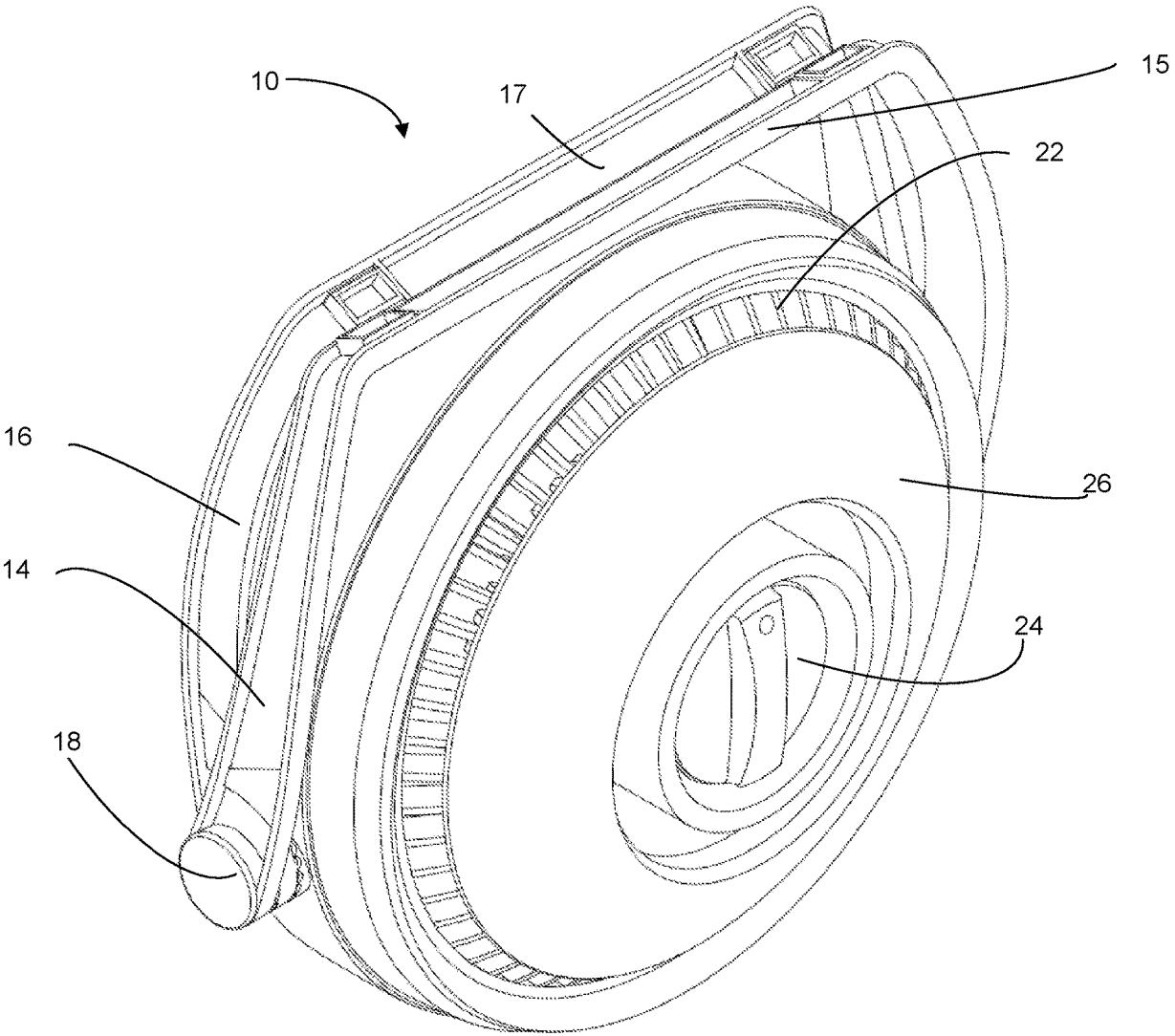
FIG. 3 shows rear perspective view of a fan assembly in an open position in accordance with a preferred embodiment of the present invention.

FIG. 3 shows a rear perspective view of the fan assembly 10 with the supporting legs 14, 16 in the second position shown in FIG. 2. Specifically, the supporting legs 14, 16 are shown rotated above the fan main body 12 so that the lower leg sections 15, 17 are in close proximity. As further shown in FIG. 3, the rear of the fan assembly 10 preferably may further include an air inlet grill 22 for allowing air pulled by the fan blades 25 to enter the fan assembly main body 12. Additionally, the fan assembly 10 may further include a control switch 24 or the like to control power to the fan assembly 10 and to control the speed of the fan blades 25. In accordance with a further preferred embodiment of the present invention, the fan assembly 10 may preferably further include a flexible guide cone 26. Preferably, the guide cone 26 may be formed of flexible material such as silicon or the like. In operation, the guide cone 26 may preferably be formed to assume a first, closed shape where the guide cone 26 conforms to the surface of the air inlet 22. In this way, the guide cone 26 may reduce the size of the fan assembly 10. Additionally, the guide cone 26 may protect the interior of the fan assembly 10 from loose materials falling through the air inlet 22 openings.

Figure 4:
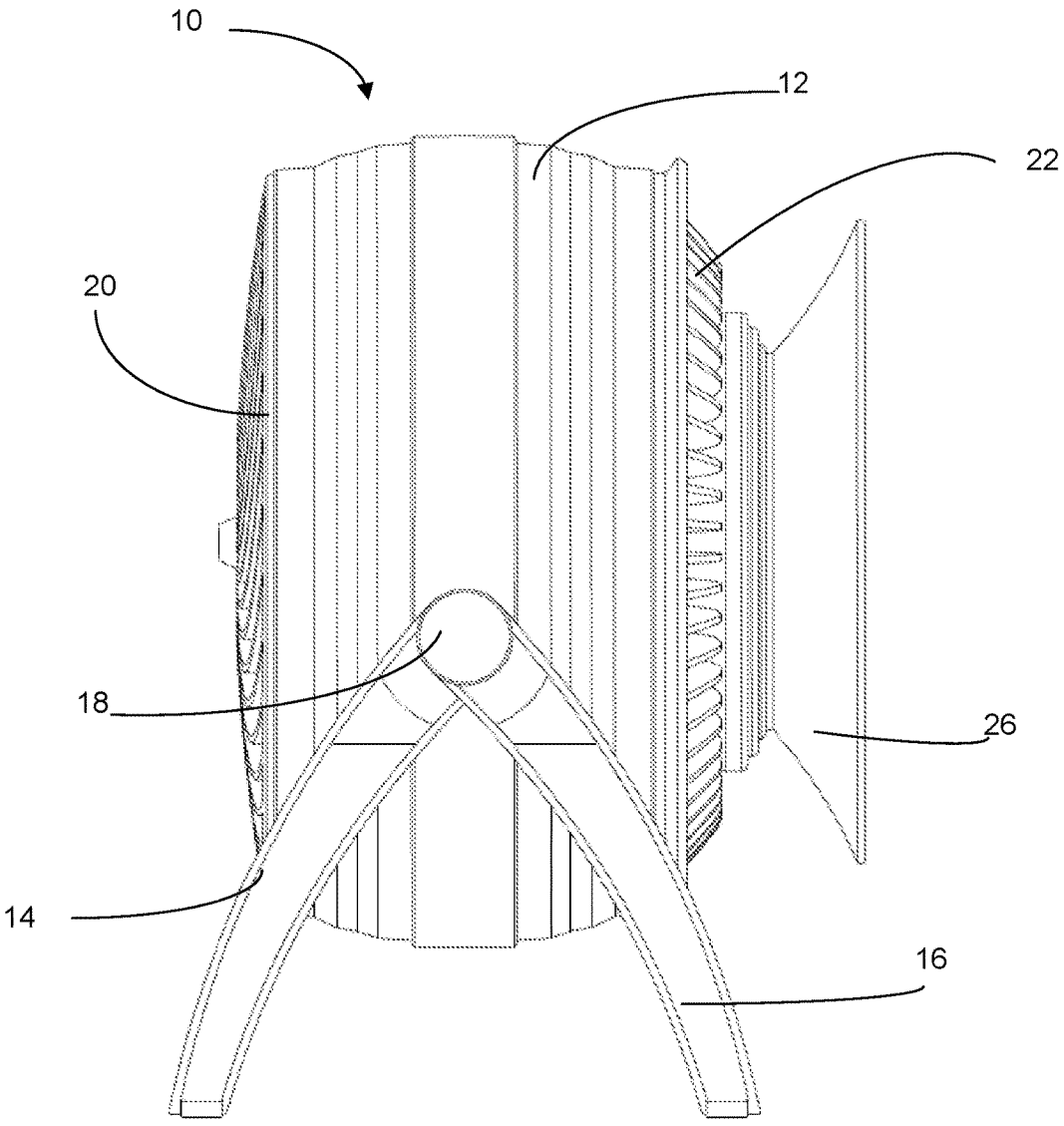
FIG. 4 shows a side view of the fan assembly shown in FIG. 3 with the fan assembly in an open position.
Figure 5:
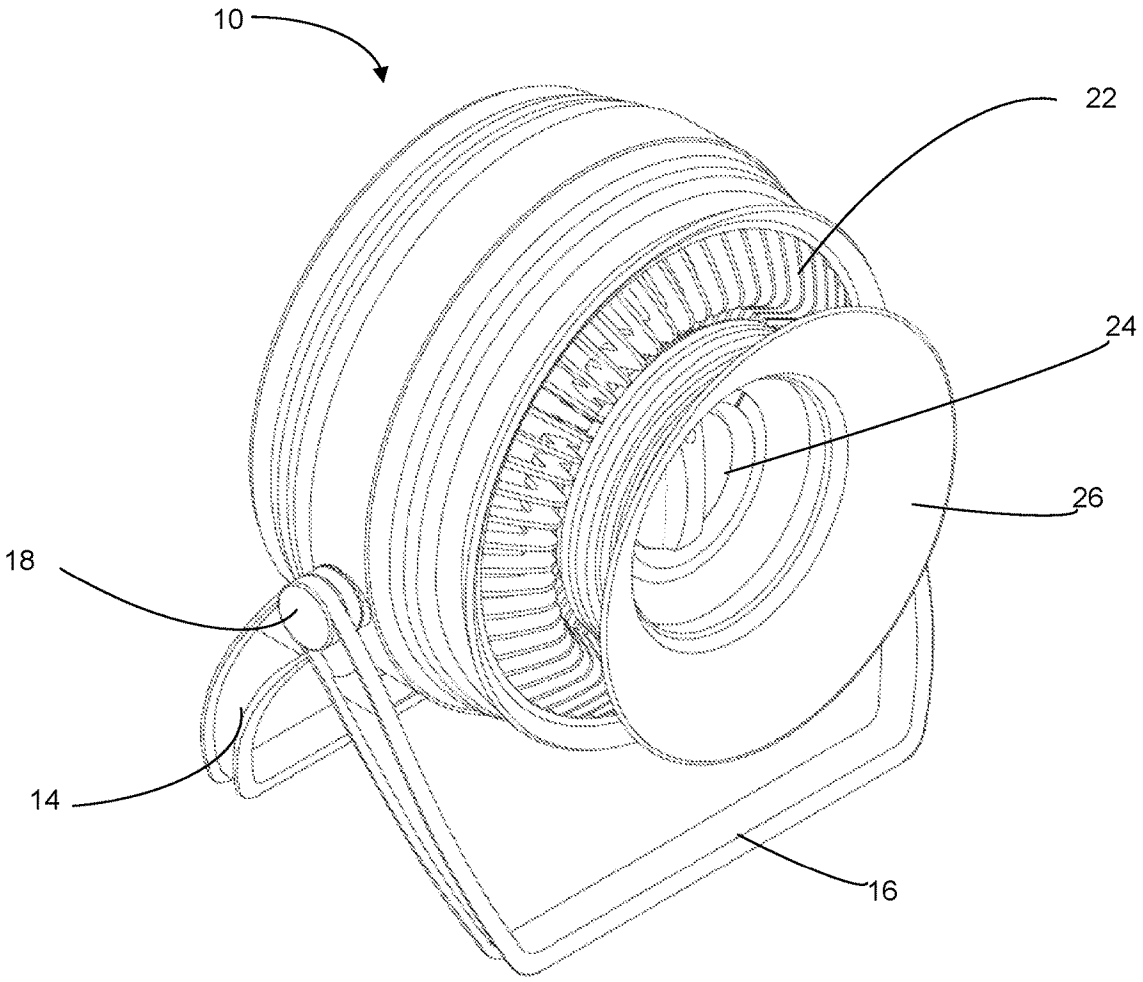
FIG. 5 shows a rear perspective view of the fan assembly shown in FIGS. 3-4 in an open configuration.

As shown in FIGS. 4-5, the guide cone 26 may preferably also be moved to a second, open position where the guide cone assumes a second, open shape. As shown in FIGS. 4-5, the guide cone 26 in the second, open position may extend away from the surface of the air inlet 22. In the second, open position, the guide cone 26 may preferably be shaped to act as a guide for air entering the air inlet 22. In this way, the guide cone 26 in the second, open position may act as an air intake channel and may increase air flow into the fan assembly main body 12.

Figure 6:
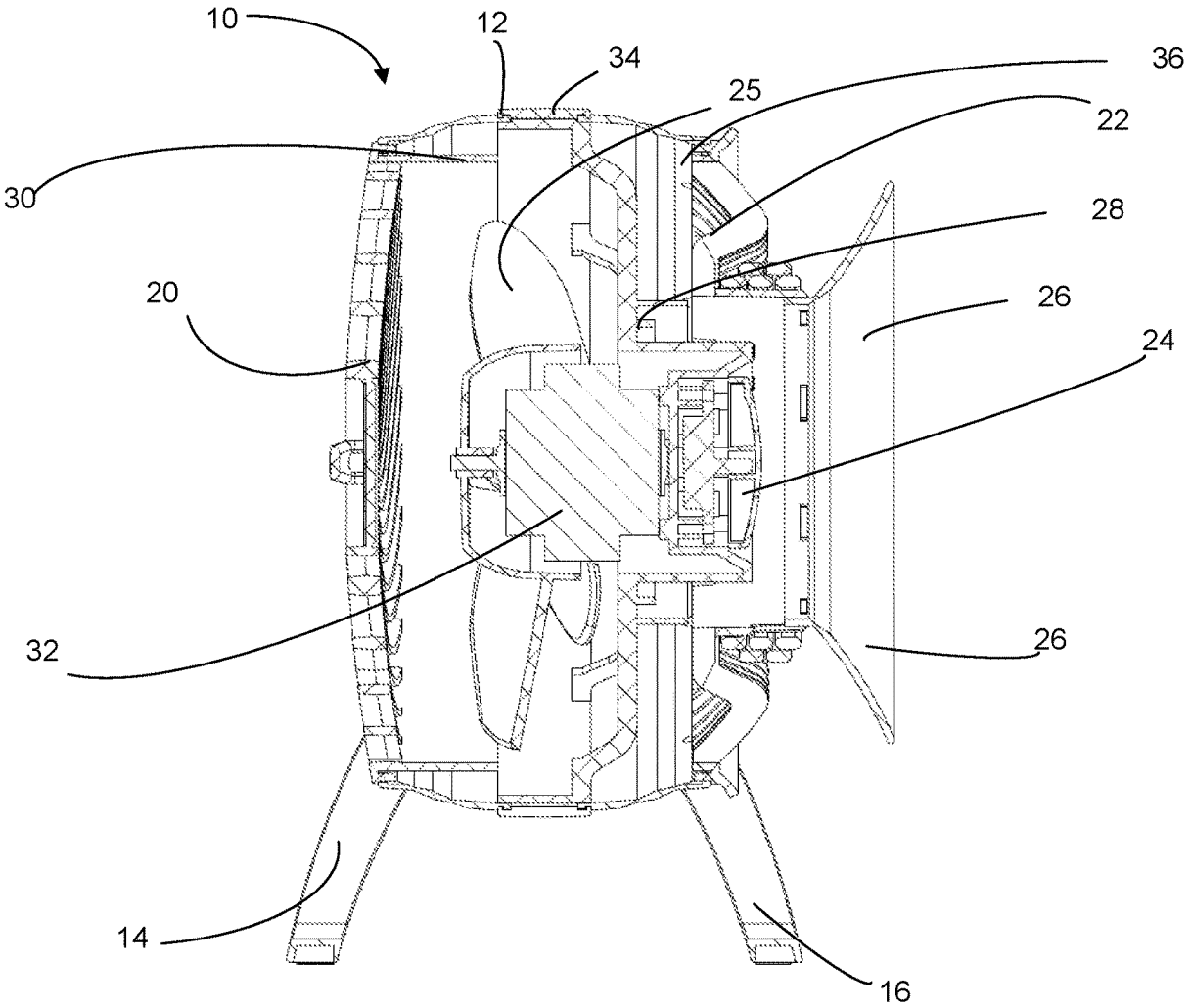
FIG. 6 shows a side cut-away view of the fan assembly shown in FIG. 5.
Figure 7:
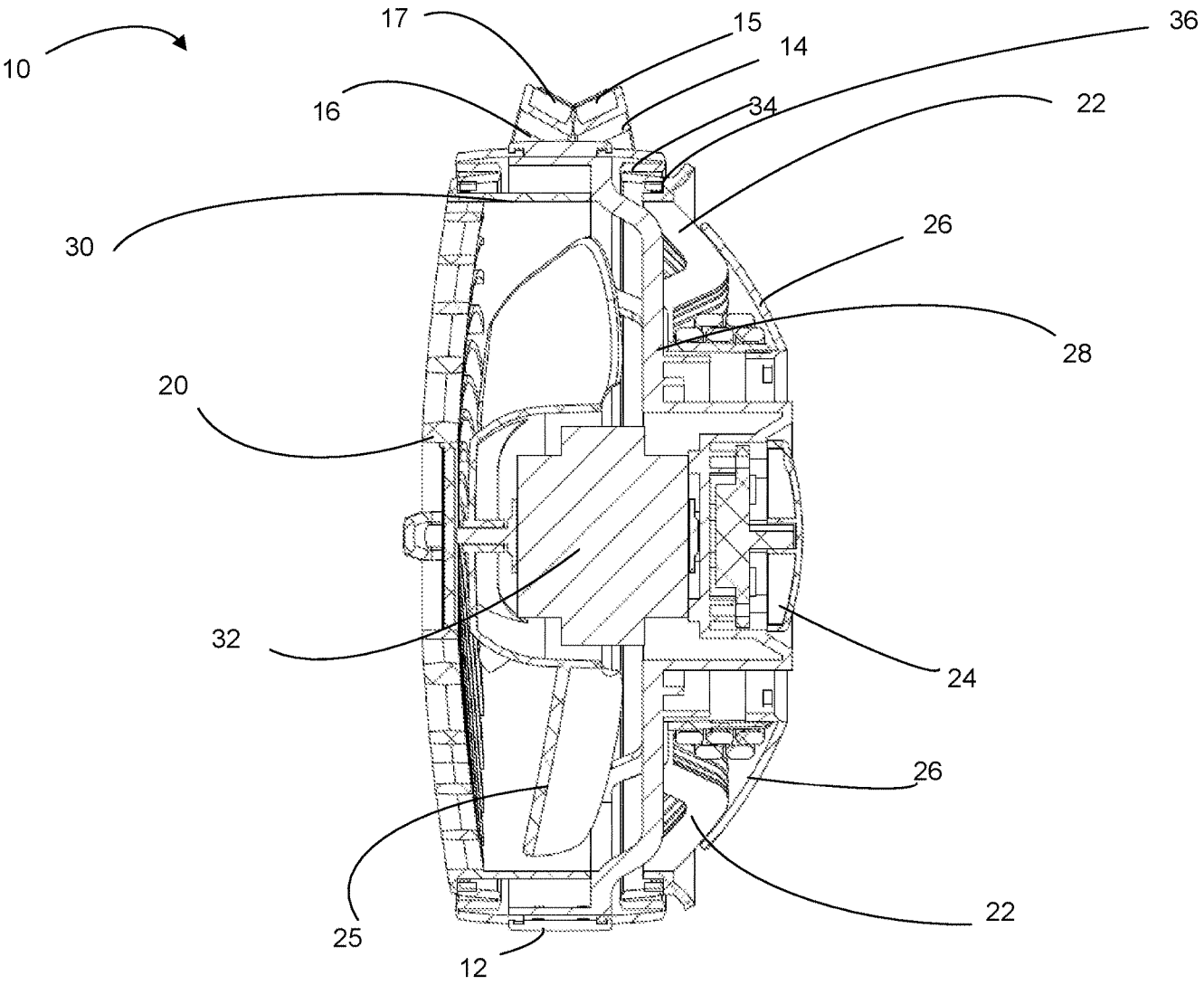
FIG. 7 shows a side cut-away view of the fan assembly shown in FIG. 6 in a closed configuration in accordance with a preferred embodiment of the present invention.

With reference now to FIGS. 6-7, side cut-away views of the exemplary fan assemblies shown in FIGS. 1-5 shall now be discussed. As shown in FIG. 6, an exemplary fan assembly 10 of the present invention may preferably include a fan main body 12 enclosing a set of fan blades 25. The fan main body 12 may also include an enclosing hoop/outer surface 34 which may be formed of molded plastic, PVC, PP Copolymer or the like. The fan main body 12 may preferably also include a front bezel 30, a rear bezel 36 and a protective frame/armature 28 to strengthen the fan main body 12 and to provide rigidity to the enclosing hoop/outer surface 34.

As discussed above, the fan main body 12 may include one or more air inlets 22 to direct air to the fan blades 25 which preferably then direct the air out through the front grill 20. As shown in FIG. 6, the fan assembly 10 may include front and rear supporting legs 14, 16 which may extend to a standing position. As further shown, the exemplary fan assembly 10 may preferably further include a motor 32. The motor 32 may preferably be an O-frame motor or the like without limitation. The electrical current to the motor may preferably be controlled via a control switch/knob 24 or the like. As discussed above, the fan assembly 10 may include a flexible guide cone 26. As shown in FIG. 6, the guide cone 26 may be formed to adopt an open position which extends away from the surface of the air inlet 22. As shown in FIG. 7, the fan assembly 10 may be moved to a closed position. In an exemplary closed position, the guide cone 26 may preferably be moved to adopt a first, closed shape where the guide cone 26 conforms to the surface of the air inlet 22. Further, the supporting legs 14, 16 may preferably be moved to a second position (as shown in FIG. 7) so that their respective lower leg sections 15, 17 are in close proximity and/or touching. In this way, the lower leg sections 15, 17 may be positioned to act as a handle or the like.

Preferably, the front bezel 30 is attached to the front of the armature 28 and the rear bezel 36 attached to the back of the armature 28. Preferably, the rear bezel 36 is secured to the armature 28 (via interlocking ribs and grooves, secured by an external hoop) and the inlet grill 22. Similarly, the front bezel 30 is preferably secured to the front grill 20 with interlocking ribs and grooves.

According to preferred embodiments, the front and rear bezels 30, 36 may be designed to allow the outlet grill 20 and the inlet grill 22 to expand/move out from the center of the fan main body 12 for use. Alternatively, the outlet grill 20 and the inlet grill 22 may be collapsed/moved to the center of the fan for storage. An exemplary design of a bezel may preferably allow for 3 sections of more rigid silicon, and 2 flexible sections of relatively thin material to create a hinge for the bezel to collapse. According to a further preferred embodiment, the preferred 3 section design of the present invention preferably allows for a given bezel to collapse to ⅓ of its extended position thus creating a significant reduction in overall depth. In a collapsed position, the fan blade 25 may preferably be close to the front and back grills 20, 22, but not touching. In this way, if the fan is energized, it may still be able to rotate while guarded adequately to comply with safety standards.

According to a further preferred embodiment, the armature 28 may also act as a cord wrap feature allowing a cord to wrap around the central cylindrical surface of the armature 28. Further, the guide cone 26 may be formed to collapsed over the cord to secure the cord in place for easy travel and storage.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An air circulation system, wherein the air circulation system comprises:

a fan main body, wherein the fan main body encloses a plurality of fan blades;

a front grill;

a front supporting leg, wherein the front supporting leg comprises a front lower leg portion; wherein the front supporting leg is movable from a first position to a second position; wherein the front lower leg portion is located beneath the fan main body when the front supporting leg is in the first position; further wherein the front lower leg portion is positioned above the fan main body when in the front supporting leg is in second position;

a rear supporting leg, wherein the rear supporting leg comprises a rear lower leg portion; wherein the rear supporting leg is movable from a third position to a fourth position; wherein the rear lower leg portion is located beneath the fan main body when the rear supporting leg is in the third position; wherein the rear lower leg portion is positioned above the fan main body when the rear supporting leg is in the fourth position;

an air inlet grill, wherein the air inlet grill is configured to allow air to flow into the fan main body; and a flexible guide cone; wherein the flexible guide cone is attached to the fan main body; wherein the flexible guide cone is configured to form a first shape and a second shape; wherein the guide cone is configured to conform to the surface of the air inlet when in the first shape; further wherein the guide cone is configured to extend away from the air inlet when in the second shape.

2. The system of claim 1, wherein the fan main body comprises an enclosing outer surface; wherein the enclosing outer surface comprises PP Copolymer.

3. The system of claim 2, wherein the fan main body comprises a front bezel.

4. The system of claim 3, wherein the fan main body comprises a rear bezel.

5. The system of claim 4, wherein the fan main body comprises a central armature.

6. The system of claim 1, wherein the front and rear supporting legs form a supporting platform for the fan main body when the front supporting leg is in the first position and the rear supporting leg is in the second position.

7. The system of claim 6, wherein the front lower leg portion and the rear lower leg portion are proximal to each other when the front lower leg portion is in the third position and the rear lower leg portion is in the fourth position.

8. The system of claim 4, wherein the front bezel is attached to a front portion of the armature; further wherein the rear bezel is attached to a rear portion of the armature.

9. The system of claim 8, wherein the front bezel comprises three rigid silicon sections; wherein the front bezel comprises a first front section and a second rear section; wherein the first front section and the second rear section form a first hinge; wherein the first hinge is configured to allow the front bezel to collapse to a reduced depth.

10. The system of claim 9, wherein the rear bezel comprises three rigid silicon sections; wherein the rear bezel comprises a third front section and a fourth rear section; wherein the third front section and the fourth rear section form a second hinge; wherein the second hinge is configured to allow the rear bezel to collapse to a reduced depth.

* * * * *